United States Patent [19]

Schade, Jr.

[11] 4,302,718

[45] Nov. 24, 1981

[54] REFERENCE POTENTIAL GENERATING CIRCUITS

[75] Inventor: Otto H. Schade, Jr., North Caldwell, N.J.

[73] Assignee: RCA Corporation, New York, N.Y.

[21] Appl. No.: 153,628

[22] Filed: May 27, 1980

[51] Int. Cl.[3] ..... G05F 3/16

[52] U.S. Cl. ..... 323/313; 323/315; 307/296 R; 330/288

[58] Field of Search ..... 323/311, 312, 313, 314, 323/315, 316, 226; 307/296 R, 297; 330/257, 288, 291, 297

[56] References Cited

U.S. PATENT DOCUMENTS

| | | | |
|---|---|---|---|
| 3,617,859 | 11/1971 | Dobkin et al. | 323/313 |
| 3,714,600 | 1/1973 | Kuijk | 330/288 |
| 3,851,241 | 11/1974 | Wheatley, Jr. | 323/226 |
| 3,887,863 | 6/1975 | Brokaw | 323/314 |
| 4,019,071 | 4/1977 | Ahmed | 307/296 R |
| 4,058,760 | 11/1977 | Ahmed | 323/314 |
| 4,059,793 | 11/1977 | Ahmed | 323/313 |
| 4,063,149 | 12/1977 | Crowle | 323/315 |
| 4,172,992 | 10/1979 | Culmer et al. | 323/316 |

OTHER PUBLICATIONS

R. J. Widlar, "New Developments in IC Voltage Regulators", IEEE Journal of Solid-State Circuits, vol. SC-6, No. 1., Feb. 1971, pp. 2-7.

K. E. Kuijk, "A Precision Reference Voltage Source", IEEE Journal of Solid-State Circuits, vol. SC-8, No. 3, Jun. 1973, pp. 222-226.

*Primary Examiner*—William M. Shoop
*Assistant Examiner*—Peter S. Wong
*Attorney, Agent, or Firm*—P. J. Rasmussen; P. M. Emanuel; C. A. Berard, Jr.

[57] ABSTRACT

A reference potential generating circuit, suitable for use as an extrapolated band-gap reference potential generator, includes first and second transistors operated at different emitter current densities wherein the difference between their base-emitter offset potentials is applied to a first resistor connected between their respective bases. That difference potential is scaled up across a second resistor to provide a component of the reference potential. Current proportional to the collector current flow in the second transistor is generated and applied to the second resistor, the collector current of the second transistor being only a fraction of the current flow in the second resistor whereby the value of the second resistor is reduced. This generated current can be the current flowing between the collector and emitter electrodes of a third transistor connected emitter-to-emitter and base-to-base with the second transistor, for example.

22 Claims, 11 Drawing Figures

Fig. 5
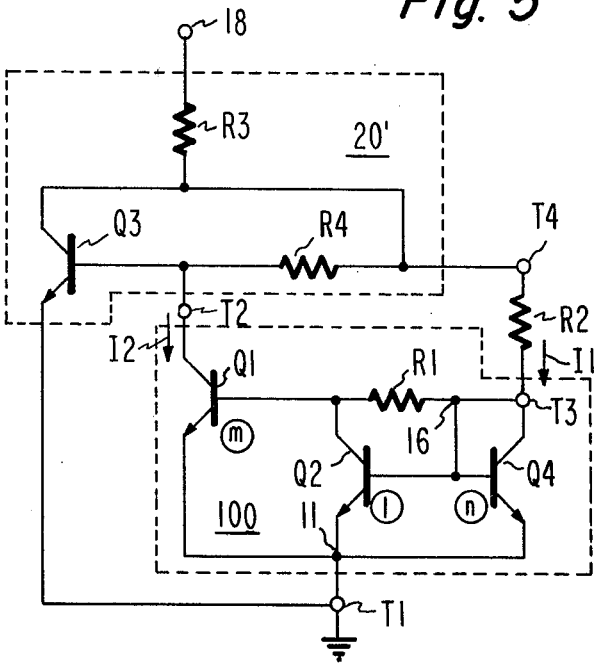
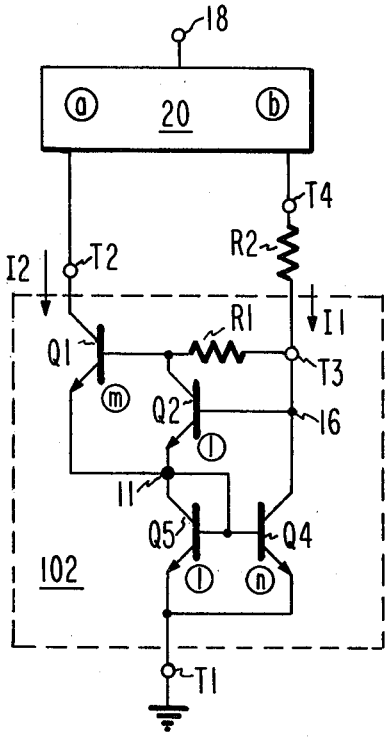
Fig. 6
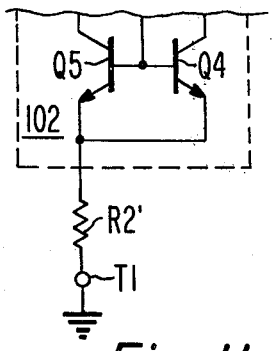
Fig. 11

REFERENCE POTENTIAL GENERATING CIRCUITS

This invention relates to circuits for generating a reference potential and more particularly to such circuits in which a component of the reference potential is provided by scaling up the difference between the offset potentials of semiconductor junctions operated with different densities of current flow through them.

Such circuits are widely used in monolithic integrated circuitry. Certain of these circuits employ in their construction first and second transistors of like conductivity type with their emitters interconnected without substantial intervening impedance and with their bases connected to first and second ends, respectively, of a first resistor. The collector of the second transistor connects to the first end of the first resistor, so the potential drop across the first resistor as applied between the bases of the first and second transistors varies linearly with the collector current of the second transistor.

The configuration thus far described provides a current amplifier with input connection to a node at the second end of said first resistor, with output connection from the collector of the first transistor, and with common connection to the interconnected emitters of the first and second transistors. This current amplifier provides current gain that decreases exponentially with increase in input current. This current amplifier is provided with a direct coupled regenerative current feedback connection from output to input connection; and the current levels in the loop thus formed tend to increase until the reduction in the current gain of the current amplifier suffices to reduce open-loop current gain to unity. In certain of these arrangements the current feedback connection is through a second resistor, for providing across the second resistor a scaled-up voltage drop proportional to the voltage drop across the first resistor, which latter drop is equal to the $\Delta V_{BE}$ difference between the respective emitter-base voltages $V_{BE1}$ and $V_{BE2}$ of the first and second transistors. Arrangements are also known where the second resistor is relocated to be in emitter connections of the first and second transistors.

In these prior art circuits it is generally desired to augment $V_{BE2}$, which exhibits a negative temperature coefficient, with a positive temperature coefficient potential proportional to $\Delta V_{BE}$, to obtain a temperature compensated potential. Practically speaking, this requires a potential drop across the second resistance, obtained by the scaling up by an order of magnitude or more of a rather modest $\Delta V_{BE}$ potential across the first resistor. In the prior art circuits described above, this large scaling factor is achieved by making the resistance of the second resistor to be much larger than that of the first resistor. The accuracy with which $\Delta V_{BE}$ can be scaled up depends upon the accuracy with which the ratio of the resistance of the second resistor to that of the first can be maintained, which latter accuracy becomes harder to maintain as the ratio departs from unity.

Embodiments of the present invention result from modifying any of the reference potential generating circuitry just described by including means for generating a current that is proportionally related to the collector current of the second transistor and causing it, as well as the collector current of the second transistor, to flow through the second resistor. This desirably allows the ratio of the value of the second resistor to that of the first resistor to be reduced, so it more closely approaches unity value. This means for generating a current proportionally related to the collector current of the second transistor generally includes a third transistor connected emitter-to-emitter and base-to-base with the second transistor and arranged to have the current flowing between its collector and emitter electrodes flow through the second resistor but not through the first resistor.

In the drawings:

FIGS. 3, 5, 6, 7, 8, 9, 10 and 11 are schematic diagrams of different embodiments of the invention.

Figure 1:
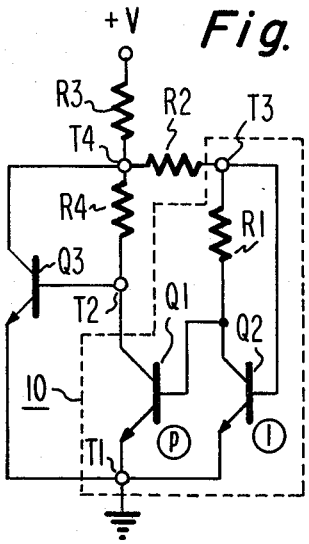
FIGS. 1 and 2 are schematic diagrams of prior art circuits.

FIG. 1 shows a circuit for generating reference potentials described by A. A. A. Ahmed in U.S. Pat. No. 4,059,793 issued Nov. 22, 1977 and entitled "SEMICONDUCTOR CIRCUITS FOR GENERATING REFERENCE POTENTIALS WITH PREDICTABLE TEMPERATURE COEFFICIENTS." Ahmed's circuit scales up the positive-temperature coefficient $\Delta V_{BE}$ potential, appearing as the difference between the emitter-to-base potentials $V_{BE1}$ and $V_{BE2}$ of transistors Q1 and Q2, and adds that scaled-up potential to negative-temperature-coefficient $V_{BE1}$ to establish a reference potential.

Ahmed regulates the reference potential between terminals T1 and T4 by a degenerative feedback, shunt-regulator circuit—NPN transistor Q3 conducting increases current responsive to increase in the reference potential applied to its base through resistor R4. This voltage-to-current feedback interacts with the current supplied from source +V via resistance R3 for maintaining the reference potential between terminals T1 and T4 substantially constant.

NPN transistors Q1 and Q2 operate at different emitter current densities. Typically, current density in Q2 is established at 10 times that of Q1 causing a $\Delta V_{BE}$ potential of 60 mV with a +0.2 mV/°K. coefficient to be established across R1. That potential is scaled up to about 600 mV across resistor R2 and exhibits a +2 mV/°K. positive temperature coefficient. The base-emitter potential $V_{BE2}$ of Q2 at terminal T3 is about 650 millivolts (mV) and exhibits −2 mV/°K. temperature coefficient. The resulting reference potential at terminal T4 is about 1.20 volts (the so-called "extrapolated band gap voltage" of silicon) and exhibits substantially zero temperature coefficient.

One practical limitation of such circuits is that they require about 10:1 ratio of the resistance of resistor R2 to that of R1. In integrated circuit technology, it is difficult to achieve an accurate initial ratio departing so far from 1:1 ratio. Further, a relatively large chip area is needed for relatively high value resistor R2. This large chip area adversely effects both the cost and the yield per wafer of such monolithic integrated circuits.

Figure 2:
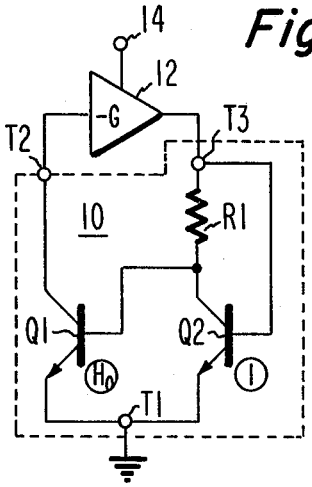
PRIOR ART Fig. 2

FIG. 2 is a known current regulating circuit of the type shown in U.S. Pat. No. 4,063,149 issued to B. Crowle on Dec. 13, 1977 wherein current amplifier 12, having current gain −G, forms a current loop with non-linear amplifier network 10 of type similar to Ahmed's. Crowle's circuit is at equilibrium when the ratio of the collector currents in Q1 and Q2 equals the value G of amplifier 12. At balance, a regulated current equal to the sum of the collector currents of Q1 and Q2 is supplied at terminal 14.

When modified by inserting terminal T4 and a second resistor R2 in series between the output connection of amplifier 12 and terminal T3, a circuit for generating zero-temperature-coefficient reference potential is provided. This circuit like the FIG. 1 circuit exhibits the shortcoming that the ratio of the resistance of R2 to that of R1 is larger than one would like.

Figure 3:
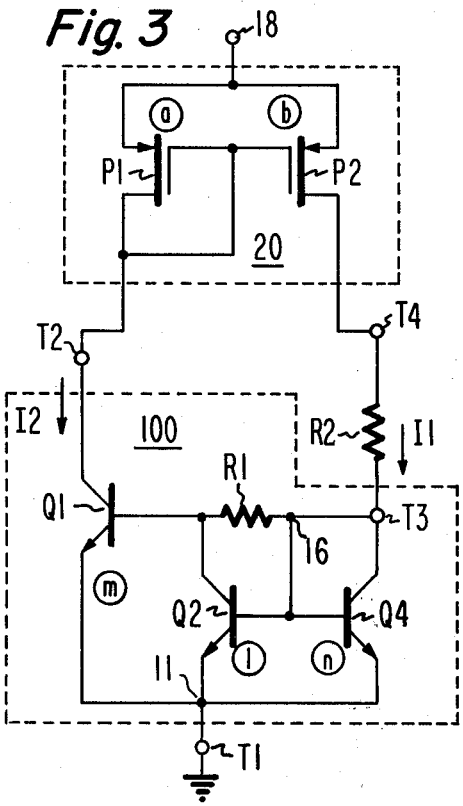
PRIOR ART Fig. 3

FIG. 3 is a reference generating circuit including non-linear current amplifier 100 and means 20 for supplying operating currents thereto. Transistors Q1, Q2 and Q4 have a shared emitter connection 11 directly connected to terminal T1. Transistor Q1 conducts current $I_2$ between output terminal T2 and shared emitter connection 11 responsive to input current $I_1$ applied to transistor Q2 at input terminal T3. Current $I_1$ is in part conducted to shared emitter connection 11 through the collector-emitter path of Q2 and resistor R1.

Q4 generates a current proportionally related to the collector current in transistor Q2 and conducts that current between terminals T3 and 11 via its collector-emitter conduction path. The sum of the Q2 and Q4 currents is applied to resistor R2 generating a proportional potential thereacross.

The relationship between the respective collector currents of Q2 and Q4 may be understood by considering those transistors as a current mirror amplifier. With Q2 to Q4 current ratio of n, Q4's collector current is $[n/(n+1)]\ I_1$ while Q2's collector current is $[1/(n+1)]\ I_1$. The respective emitter areas l and n of transistors Q2 and Q4 are indicated in the FIGURES by encircled characters.

The ratio of current demand $I_2$ in Q1 to the current $I_1$ applied at T3 is determined by fixed physical features of Q1, Q2 and Q4. The current ratio of amplifier 100 is derived from the basic equation describing transistor action, $$V_{BE}=(kT/g)\ \ln\ (I_C/AJ_S) \tag{1}$$

wherein:

$V_{BE}$ is the base-emitter potential of the transistor, k is Boltzmann's constant, T is absolute temperature of the transistor base-emitter junction, q is the charge on an electron, $I_C$ is the collector-emitter current of the transistor, A is the area of the transistor base-emitter junction, and $J_S$ is the emitter current density during saturation of the transistor.

In the equations, numerical subscripts relate the quantities to the particular transistor having the corresponding identification numeral. For simplicity of analysis, emitter current is assumed to be substantially equal to collector current, i.e., base current is negligibly small and the common-emitter forward current gain $h_{FE}$ of the transistor is reasonably large.

Area A denotes a standardized transistor area and modifications thereto are indicated by multiplying factors n or m of the respective transistors. $J_S$ may be assumed to be the same for each respective transistor because, in a monolithic-integrated-circuit preferred embodiment, those transistors are fabricated by the same process steps and are in close proximity so as to have substantially equal junction temperatures.

From FIG. 3, it is apparent that $$V_{BE1}=V_{BE2}-I_{C2}R1 \tag{2}$$

Substituting equation (1) for the respective transistors Q1 and Q2 into equation (2) provides $$I_2=[(mI_1)/(n+1)]\exp[(-I_1R_1q)/(n+1)(kT)] \tag{3}$$

Thus, the input-to-output current ratio $I_2/I_1$ of non-linear current amplifier 100 is exponential in form; the incremental increase in current $I_2$ becomes smaller as the magnitude of current $I_1$ becomes larger.

Current amplifier 20 applies current $I_1$ to amplifier 100 via terminal T4 and resistance R2 while also meeting the resulting Q1 collector current demand $I_2$ at terminal T2 thereby completing a regenerative feedback connection. Operating potential is applied between terminals 18 and T1; T1 may be at ground potential, for example. Amplifier 20 is, for example, a current mirror amplifier including diode connected input FET P1 and output FET P2 with respective channel width-to-length ratios of a and b, as indicated by the encircled letters next to P1 and P2. The ratio of output current supplied to terminal T4 to input current received from terminal T2

$$I_1=(b/a)I_2. \tag{4}$$

Equilibrium of the regenerative current loop is reached at the current level where the product of the $I_2$-to-$I_1$ ratio of amplifier 100 multiplied by the current gain of amplifier 20 is unity. Substituting equation (3) into equation (4) and solving provides $$I_2=(a/b)[(n+1)/R_1](kT/q)\ \ln\ [m(b/a)/(n+1)] \tag{5}$$

Stability is assured because equilibrium current is completely determined by constants, the value of resistor R1, and absolute temperature T.

While the circuit of FIG. 3 can generate a predetermined reference potential at terminal T4 with respect to terminal T1 having one of a range of predetermined values and temperature coefficients, it is particularly useful for generating a potential therebetween exhibiting zero temperature coefficient. One such potential is related to the bandgap potential of the semiconductor material extrapolated to zero Kelvin which, for silicon, has a value of about 1.2 volts. To do this, the potential across R2 has to be approximately 10 times that across R1. Such potential ratios can be obtained with smaller resistance ratios (R2/R1) when one employs the present invention. The required value of R2 is reduced by a factor $1/(n+1)$ from the value that would be required in the FIG. 1 prior art circuit. For example, if transistor Q4 has emitter area n=4, the R2/R1 ratio is only 2. Suitable values of the factors m, a, and b may then be selected according to equation (5) and the criteria for band-gap voltage references. These criteria are known, for example, from Widlar, "New Developments in IC Voltage Regulators", *IEEE Journal of Solid-State Circuits,* Volume SC-6, No. 1, February, 1971, pages 2–7. Thus, the additional current flow in R2, caused by current flow through Q4 proportional to that in Q2, results in an advantageous decrease in the required resistance value of R2.

The circuit of FIG. 3 could also be employed to generate a controlled current between terminals 18 and T1 in the manner of Crowle. The resulting constant current at terminal 18 or T1 is $$I=(1+b/a)I_2 \quad (6)$$

where $I_2$ is given by equation (5).

While PNP bipolar transistors could be used in current amplifier 20, the embodiment of FIG. 3 avoids base current errors in current amplifier 20 and is well suited to monolithic construction in complementary MOS FET integrated-circuit technology. In this technology, both P-channel and N-channel FETs are available as well as less-commonly-used NPN transistors of lateral construction.

Figure 4:
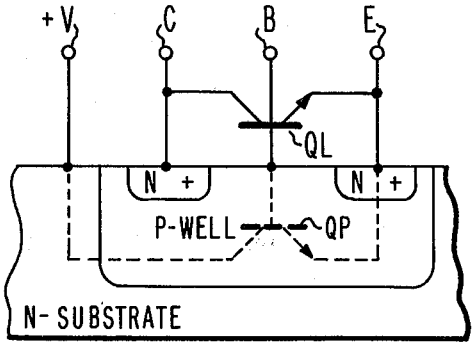
FIG. 4 is a schematic diagram of another transistor embodiment with which the invention is useful.

FIG. 4 shows one such lateral NPN transistor QL having a collector C, base B, and emitter E. One problem with lateral transistors is caused by the parasitic NPN transistor QP, shown in phantom, and the substantial emitter current it supplies. That current, which is difficult to predict or control, necessarily flows in the shared emitter E of QL and QP. The circuit of the present invention avoids the deleterious effects caused by emitter current from parasitic transistor QP because the respective emitters of transistors Q1, Q2 and Q4 connect directly to shared connection 11. Emitter current from parasitic transistor QP does not flow through scaling resistors R1 and R2 and so it does not affect the bandgap reference potential between T4 and T1.

FIG. 5 is an alternative embodiment of a reference potential generating circuit employing current amplifier 100 of FIG. 3. Within current supply 20', $I_1$ is supplied to T3 from supply 18 via resistors R3 and R2, and current demand $I_2$ of Q1 is supplied through resistor R4. NPN transistor Q3 completes, in effect, a shunt voltage regulator circuit for the potential at T4 in like manner to the FIG. 1 circuit.

The desired reference potential between T4 and T1—for example, the band-gap potential of silicon—is of predetermined magnitude determined by the non-linear current ratio of circuit 100 from equation (3) and the values of resistors R4 and R2. If the potential at T4 tends to increase above equilibrium value, current flow in R4 tends to exceed the collector current in Q1 tending to increase conduction in Q3 to maintain the desired output potential at T4. If the potential at T4 tends to fall below that equilibrium value, the collector current of Q1 tends to exceed the current flow in R4 reducing conduction in Q3 to maintain equilibrium potential at T4.

The reference generator circuit of FIG. 3 could also be employed to generate an augmented reference potential between T4 and T1 by the inclusion of at least one semiconductor junction in series with R2 between terminals T3 and T4. To counteract the increased combined negative temperature coefficient of $V_{BE2}$ and that further junction, without increasing the resistance of R2, the emitter area n of Q4 could be further increased according to the foregoing description of the present invention to maintain the R2/R1 ratio at a low value, even approaching unity.

FIG. 6 shows an augmented voltage reference potential generating circuit employing non-linear current amplifier 102. Circuit 102 differs from amplifier 100 in that it includes a current mirror amplifier formed by diode-connected input transistor Q5 interposed between connection 11 and terminal T1, and by output transistor Q4 connected between terminals T3 and T1, for proportioning the relative currents flowing in resistors R2 and R1, instead of this being done by the Q2, Q4 current mirror amplifier as in amplifier 100.

Augmented reference potential appears between T4 and T1 and includes the forward-conduction potentials of the respective base-emitter junctions of Q2 and Q5 and the potential across resistor R2. Current $I_1$ is a multiple of the current flowing in resistor R1, the multiplication factor being determined by the emitter areas ratio n associated with transistor Q4 and the b:a ratio of current supply 20. Because the current in R1 has a positive temperature coefficient, current $I_1$ and the potential across R2 also exhibit a positive temperature coefficient. That positive temperature coefficient tends to counteract the negative temperature coefficient of the sum of the base-emitter potentials of Q2 and Q5. The circuit of FIG. 6 can generate a reference potential of substantially twice the value of the zero-temperature-coefficient, bandgap potential of silicon.

Amplifier 102 allows further reduction of the value of resistor R2 relative to that required for the FIG. 1 or FIG. 3 circuits when they are modified to generate twice bandgap potential. That further reduction in the R2/R1 ratio results because of Q4 generates a current proportional to sum of the Q1 and Q2 currents, which proportional current is applied to R2.

Figure 7:
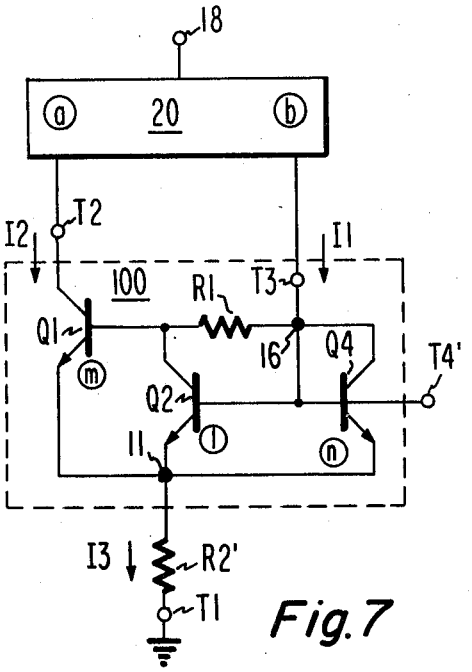

The embodiment of FIG. 7 differs from that of FIG. 3 in that resistor R2 is replaced by direct connection and resistor R2' is interposed between shared emitter connection 11 and terminal T1. Reference potentials generated between terminals T4' and T1 include the base-emitter potential of Q2, which exhibits a negative temperature coefficient, and the potential across resistor R2', which exhibits a positive temperature coefficient. Because resistor R2' conducts a current $I_3$ equal to the sum of currents $I_2$ and $I_1$ rather than $I_1$ above, its resistance is reduced compared to that of R2 for similar values of voltage drop. For example, where the current ratio of current amplifier 20 is b/a=2 and the emitter area of Q4 is n=1, the resistance of R2' is ⅓ that which would be required with FIG. 1 reference generator circuits.

Figure 8:
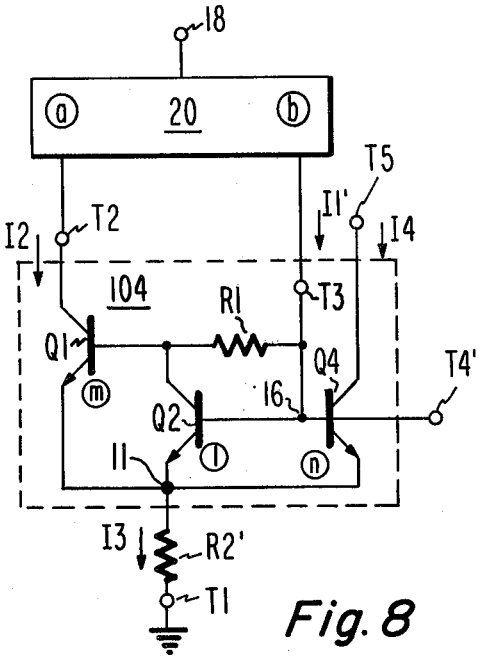

Non-linear current amplifier 104 of FIG. 8 differs from amplifier 100 of FIG. 7 in that collector-emitter current $I_4$ for transistor Q4 is supplied from supply terminal T5. So, if the ratio b/a of current amplifier 20 is the same as that for FIG. 7, so that $I_1'=I_1$, then the current $I_3$ applied to R2' proportionately increases from $$I_3=I_1+I_2=I_1(1+a/b) \quad (7)$$

to $$I_3=I_1+I_2+I_4=I_1(1+n+a/b) \quad (8)$$

and the resistance of R2' is proportionately reduced to maintain the same potential thereacross.

On the other hand, the ratio b/a could be reduced proportionately to obtain a reduction in transistor size within current amplifier 20, for example, the width-to-length ratio b of P2 or the emitter area b of a PNP substitute transistor in a bipolar equivalent current amplifier could be reduced by the factor 1/(n+1). That area reduction tends to advantageously decrease the cost, and increase the production yield when the circuit of FIG. 8 is constructed as a monolithic integrated circuit.

Operating bias for the collector of Q4 is provided by any suitable connection of T5, for example, to the relatively positive potential at terminal 18, either directly or through intervening elements. Q4 would then supply a reference current $I_4$ of predetermined value, dependent only upon the constant factors that predetermine equilibrium conditions to the intervening elements. Further, Q4 could have a plurality of collectors or could be a plurality of transistors having predetermined emitter areas with their respective base-emitter junctions connected in parallel, whereby a predetermined reference current is available at each collector.

Figure 9:
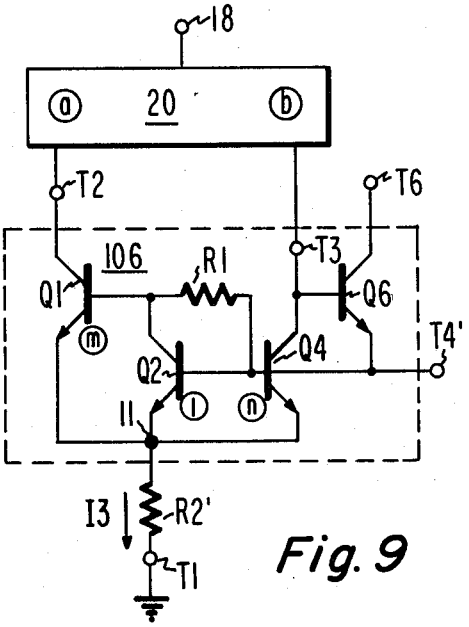

The circuit of FIG. 9 differs from the circuit of FIG. 7 in that non-linear current amplifier 106 is a further variant of amplifier 100. Emitter-follower transistor Q6 is interposed between the collector and base electrodes of Q4 to supply base currents to Q2 and Q4 to substantially reduce the errors they introduce, i.e., by a factor equal to the common-emitter current gain of Q6. Because emitter followers such as Q6 tend to provide a reduced output impedance, reference potentials between terminals T4′ and T1 tend to be less sensitive to current demands from load circuits connected therebetween, thereby improving the accuracy of the reference potential and the usefulness of the reference potential generating circuit.

Figure 10:
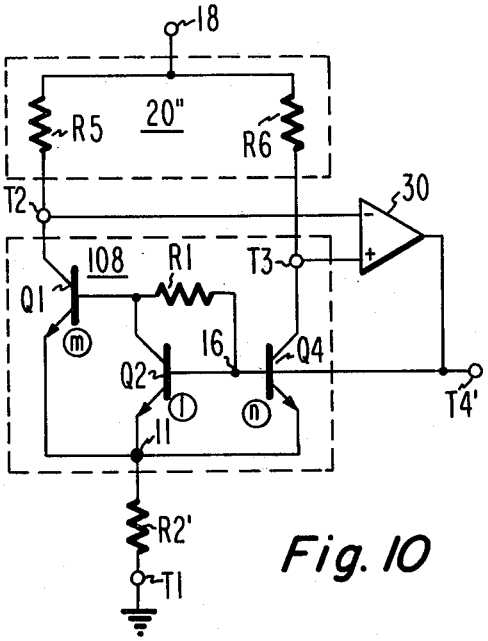

FIG. 10 differs from FIG. 9 in that resistors R5 and R6 and differential-input amplifier 30 perform the functions of current amplifier 20 and follower Q6. At equilibrium, the degenerative feedback action of amplifier 30 tends to equalize the potentials at terminals T2 and T3. Differences between the potentials at T2 and T3 cause a corresponding potential increase or decrease at the output of amplifier 30 to be coupled to connection 11 via Q2 and Q4. That causes a corresponding variation in the current flowing in R2′, which current must also flow in the parallel paths of resistors R5 and R6, thereby serving as a current feedback connection. Nonlinear amplifier 108 exhibits a predetermined relationship between current applied at T3 and current demanded at T2; at equilibrium, the respective potentials across R5 and R6 are equal, and the magnitudes and ratio of the currents therethrough correspond to the unique corresponding magnitudes and ratio of currents in circuit 108. Analytical derivation of that eqilibrium condition is performed in like manner to the derivation of equation (5) above as related to FIG. 3.

The circuit of FIG. 10 provides at least four significant advantages: first, because terminal T4′ is at the output of feedback amplifier 30, low output-impedance will be exhibited at T4′; and the reference potential between T4′ and T1 will be substantially insensitive to loading applied between them. Secondly, because the potentials at T2 and T3 are equal, no error is introduced by differences in or variations of the respective collector-emitter potentials of Q1 and Q4. Thirdly, errors introduced by Q2, Q4 base currents are eliminated, those currents being supplied by amplifier 30. Fourthly, in integrated circuit embodiments of this circuit, currents supplied through R5 and R6 can be more accurately matched, both as to initial tolerance and temperature variations, than can currents supplied by CMA 20.

While the descriptions and figures herein describe preferred alternative embodiments incorporating the present invention, one skilled in the art of design when armed with the teachings of this disclosure would be able to envision further embodiments without departing from the scope and spirit of the invention. For example, transistor Q6 in reference generating circuit 106 could be replaced by an N-channel field-effect transistor whereby the errors introduced by the base currents of Q2 and Q4 are not merely reduced but are completely eliminated. As a practical matter, integral ratios of transistor areas, e.g., a, b, m, n are realized by the parallel connection of a plurality of bipolar transistors having equal emitter areas, or by the parallel connection of a plurality of field-effect transistors having equal width-to-length ratios, as the case may be. Alternatively, base current compensation of the bipolar transistors could be provided in analageous manner to that described in U.S. Pat. No. 3,714,600 issued to Kuijk, et al on Jan. 30, 1973.

It is also satisfactory that any of the alternative embodiments of various features of the present invention be employed in combination with each other. For example, in the circuit of FIG. 6, it is satisfactory that resistor R2 be replaced by R2′ connected between the shared emitter connection of Q4 and Q5 and terminal T1, as shown in FIG. 11. In a further example, the resistance of R2 or R2′ necessary to obtain the desired reference potential could be apportioned between two resistances, one in the R2 location and the other in the R2′ location.

In further example, at least one further transistor for supplying a reference current could have its base-emitter junction connected in parallel with that of transistor Q4 in amplifiers 100, 102, 106, and 108 in the manner described for circuit 104 in FIG. 8.

What is claimed is:

1. A potential generating circuit of a type comprising:

first and second transistors of like conductivity type, each having collector, base and emitter electrodes, each having a base-emitter junction, and each having a collector-emitter conduction path, which emitter electrodes respectively connect together at a first node;

a first resistance with a first end to which the base electrode of said first transistor and the collector electrode of said second transistor connect, and with a second end;

a second node to which the base electrode of said second transistor and the second end of said first resistance connects;

a regenerative current feedback connection from the collector electrode of said first transistor to said second node;

a second resistance in predetermined proportion with said first resistance, and having first and second ends;

means arranging said second resistance in series connection with the collector-emitter conduction path of said second transistor, so the current flowing through the collector-emitter conduction path of said second transistor flows through said second resistance to cause a potential drop thereacross for generating an output potential across said series connection;

improved by further comprising:

means for generating a current proportionally related to the current in the collector-emitter conduction path of said second transistor; and means applying said proportionally related current to said second resistance for proportionally increasing the potential drop thereacross.

2. The circuit of claim 1 wherein said means for generating a current comprises:

a third transistor of the same conductivity type as that of said first and second transistors, having base and emitter electrodes and a base-emitter junction therebetween, and having a collector electrode, which emitter electrode connects to said first node, and which base electrode connects to said second node; and means connecting the collector electrode of said third transistor for supplying its collector current demand.

3. The circuit of claim 2 wherein said means for supplying includes a connection of the collector electrode of said third transistor to said second node.

4. The circuit of claim 1, 2 or 3 wherein said means applying said proportionally related current includes a connection of one of the ends of said second resistance to said first node.

5. The circuit of claim 2 wherein said regenerative feedback connection includes:

a fourth transistor of like conductivity type to that of said first and second transistors, having output and common electrodes and a conduction path therebetween, and having an input electrode to which its conduction path is responsive;

an intermediate node;

means connecting said fourth transistor in voltage-follower connection including a connection of its common electrode to said second node, means connecting its output electrode for supplying the current demand thereat, and means connecting its input electrode to said intermediate node; and wherein said means for supplying includes a connection of the collector electrode of said third transistor to said intermediate node.

6. The circuit of claim 2 wherein said regenerative current feedback connection includes:

a supply terminal for receiving operating potential thereat;

a third resistance connected at a first end to said supply terminal and at a second end to the collector electrode of said first transistor;

an intermediate node;

a fourth resistance connected at a first end to said supply terminal and at a second end to said intermediate node;

differential-input amplifying means having an inverting input terminal to which the second end of said third transistor connects, having a non-inverting input terminal to which said intermediate node connects, and having an output terminal for supplying signals responsive to the difference between signals at its inverting and non-inverting input terminals;

means connecting the output terminal of said differential-input amplifying means to said second node; and a connection of the collector electrode of said third transistor to said intermediate node included in said means for supplying.

7. The circuit of claim 2, 3, 5, or 6 wherein the area of the base-emitter junction of said third transistor is at least as large as that of said second transistor.

8. The circuit of claim 1 wherein said means for generating a current comprises:

current mirror amplifying means having an input connection connected to said first node, having an output connection connected to said second node, and having a common connection to a point of reference potential.

9. The circuit of claim 8 wherein said current mirror amplifying means includes:

third and fourth transistors of like conductivity type to that of said first and second transistors, each having output and common electrodes and a conduction path therebetween, and each having an input electrode to which its conduction path is responsive;

means connecting the output electrode of said third transistor to said input connection;

means connecting the output electrode of said fourth transistor to said output connection;

means connecting the respective common electrodes of said third and fourth transistors to said common connection; and means for applying signals responsive to signals at said input connection to the respective input electrodes of said third and fourth transistors.

10. The circuit of claim 9 wherein the area of the base-emitter junction of said fourth transistor is at least as large as that of said third transistor.

11. The circuit of claim 8 or 9 wherein said means applying said proportionally related current includes a connection of one of the ends of said second resistance to the common connection of said current mirror amplifying means.

12. The circuit of claim 1, 2, 3, 8 or 9 wherein said means applying said proportionally related current includes said second resistance being interposed in said regenerative current feedback connection and having one of the ends of said second resistance connected to said second node.

13. The circuit of claim 1 wherein said regenerative current feedback connection comprises:

current mirror amplifying means having an input connection connected to the collector electrode of said first transistor and an output connection connected to said second node, the current flow in the output connection of said current mirror amplifying means being proportionally related by a factor $-G$ to the current applied to the input connection thereof, and having a common connection for receiving an operating potential thereat.

14. The circuit of claim 13 wherein said current mirror amplifying means includes:

third and fourth transistors of conductivity type complementary to that of said first and second transistors, each having output and common electrodes and a conduction path therebetween, and each having an input electrode to which its conduction path is responsive;

means connecting the respective output electrodes of said third and fourth transistors to the input and output connections, respectively, of said current mirror amplifying means;

a connection of the respective common electrodes of said third and fourth transistors to the common connection of said current mirror amplifying means;

means for applying a potential responsive to the potential at the input connection of said current mirror amplifying means to the respective input electrodes of said third and fourth transistors.

15. The circuit of claim 1 wherein said regenerative current feedback connection includes a supply terminal for receiving an operating potential;

an intermediate node;

a third resistance connected between said supply terminal and said intermediate node;

a fourth resistance connected at a first end to said intermediate node and at a second end to the collector electrode of said first transistor;

a third transistor having output and common electrodes and a conduction path therebetween, and having an input electrode to which its conduction path is responsive, the output electrode of said third transistor connecting to said intermediate node, the common electrode of said third transistor connecting to said first node, and the input electrode of said third transistor connecting to the second end of said fourth resistance; and wherein a connection included within said means applying said proportionally related current of said second resistance between said second and intermediate nodes.

16. The circuit of claim 8, 9, 13, 14 or 15 wherein said means for generating a current comprises:

a further transistor of the same conductivity type as that of said first and second transistors, having base and emitter electrodes and a base-emitter junction therebetween, and having a collector electrode, which emitter electrode connects to said first node, and which base electrode connects to said second node; and means connecting the collector electrode of said further transistor for supplying its collector current demand.

17. The circuit of claim 16 wherein said means for supplying includes a connection of the collector electrode of said further transistor to said second node.

18. A non-linear current amplifier comprising:

first and second transistors of like conductivity type, having respective collector, base and emitter electrodes, which emitter electrodes connect together;

means for connecting the base electrode of said first transistor to the collector electrode of said second transistor;

resistance means connected between the respective base electrodes of said first and second transistors;

means for applying a current between the base and emitter electrodes of said second transistor for establishing collector current flow therein;

means connected across the base and emitter electrodes of said second transistor for generating a current proportionally related to the collector current flow of said second transistor;

means connected between the collector and emitter electrodes of said first transistor for receiving the current flow therein.

19. The current amplifier of claim 18 wherein said means for generating a current includes a third transistor of like conductivity type to that of said first and second transistors, having base and emitter electrodes to which the base and emitter electrodes of said second transistor respectively connect, and having a collector electrode connected to the base electrode of said second transistor.

20. The current amplifier of claim 18 wherein said means for generating a current includes current mirror amplifying means having an input connection connected to the emitter electrode of said second transistor, having an output connection connected to the base electrode of said second transistor, and having a common connection for receiving a reference potential.

21. The current amplifier of claim 20 wherein said current mirror amplifying means includes third and fourth transistors of like conductivity type to that of said first and second transistors, each having output and common electrodes and a conduction path therebetween, and each having an input electrode to which its conduction path is responsive;

means connecting the output electrode of said third transistor to said input connection;

means connecting the output electrode of said fourth transistor to said output connection;

means connecting the respective common electrodes of said third and fourth transistors to said common connection; and means for applying signals responsive to signals at said input connection to the respective input electrodes of said third and fourth transistors.

22. The current amplifier of claim 18 wherein said means for applying a current and said means for generating a current together include a third transistor of like conductivity type to that of said first and second tansistors, having base and emitter electrodes to which the base and emitter electrodes of said second transistor respectively connect, and having a collector electrode connected for receiving a current; and a fourth transistor having output and common electrodes and a conduction path therebetween, and having an input electrode to which its conduction path is responsive, the common electrode of said fourth transistor being connected to the base electrode of said second transistor, and the input electrode of said fourth transistor being connected to the collector electrode of said third transistor.

* * * * *